US006899605B1

(12) United States Patent
Lutz

(10) Patent No.: US 6,899,605 B1
(45) Date of Patent: May 31, 2005

(54) GRINDING MACHINE

(75) Inventor: Helmut Lutz, Remchingen-Nöttingen (DE)

(73) Assignee: Helmut Gegenheimer, Keltern-Dietlingen (DE)

( * ) Notice: Subject to any disclaimer, the term of this patent is extended or adjusted under 35 U.S.C. 154(b) by 0 days.

(21) Appl. No.: 09/701,338

(22) PCT Filed: Feb. 29, 2000

(86) PCT No.: PCT/EP00/01675

§ 371 (c)(1),
(2), (4) Date: Nov. 28, 2000

(87) PCT Pub. No.: WO00/56501

PCT Pub. Date: Sep. 28, 2000

(30) Foreign Application Priority Data

Mar. 19, 1999 (DE) ..... 199 12 348

(51) Int. Cl.[7] ..... B24B 31/02

(52) U.S. Cl. ..... 451/104; 451/326; 451/327; 451/328; 451/329; 451/330; 451/117

(58) Field of Search ..... 451/104, 111, 327–329, 451/326, 32, 465, 330, 117; 241/170, 284

(56) References Cited

U.S. PATENT DOCUMENTS

| | | | | |
|---|---|---|---|---|
| 5,088,238 | A * | 2/1992 | Lin | 451/113 |
| 5,279,074 | A * | 1/1994 | Davidson | |
| 5,367,833 | A * | 11/1994 | Rhoades et al. | 451/104 |
| 5,476,415 | A * | 12/1995 | Nishimura et al. | 451/326 |
| 5,823,861 | A * | 10/1998 | Kobayashi et al. | 451/326 |
| 6,296,556 | B1 * | 10/2001 | Gegenheimer | 451/326 |
| 6,379,233 | B1 * | 4/2002 | Kobayashi et al. | 451/326 |

* cited by examiner

*Primary Examiner*—Lee D. Wilson
*Assistant Examiner*—Anthony Ojini
(74) *Attorney, Agent, or Firm*—Antonelli, Terry, Stout & Kraus, LLP

(57) ABSTRACT

The invention provides a grinding machine for grinding grinding material by means of grinding bodies or wheels, having at least one grinding unit and two parts rotatable relative thereto, which has a container for receiving grinding material and a rotary disk placed above a container base, accompanied by the formation of a finite gap.

33 Claims, 4 Drawing Sheets

GRINDING MACHINE

BACKGROUND OF THE INVENTION

The invention relates to a grinding machine for grinding grinding material by means of grinding bodies or wheels, having at least one grinding unit with two parts rotatable relative to one another.

For example centrifugal force sliding grinding machines are known, which comprise a two-part container with a shell-like, rotary container lower part forming a base and a stationary, cylindrical container upper part.

Such grinding machines are used for the surface working of grinding material, e.g. smaller parts and workpieces, which are moved together with the grinding bodies and optionally a liquid process medium in the container. If the lower part is rotated, the workpieces to be treated are moved outwards on the disk until they encounter the inner wall of the container where they are decelerated. Through the subsequently flowing workpieces a revolving workpiece movement occurs, which brings about an intense grinding or polishing.

A particular disadvantage of such centrifugal force sliding grinding machines is that the sealing of the annular clearance and the guidance of the tubes bounding the same gives rise to considerable problems, which can only be overcome with considerable effort and expenditure. The danger exists that the upper and lower parts, particularly the lower part, will be very strongly heated as a result of friction if parts of the grinding material and/or additionally added grinding bodies pass during operation into the gap between the container base and the rotating disk. This on the one hand leads not only to a relatively short grinding machine service life, but said machine must be frequently switched off during the working of grinding material to avoid overheating of both the grinding machine and also the grinding and/or material.

SUMMARY OF THE INVENTION

The problem of the invention is to provide a simply constructed, inexpensive centrifugal force sliding grinding machine, which in the case of low wear susceptibility operates reliably and has a long service life.

According to the invention this problem is solved by a centrifugal force sliding grinding machine, particularly a polishing machine, of the aforementioned type having a stationary container for receiving grinding material and a rotary disk arranged above a container base for forming a finite gap with respect to the container wall.

The disk is also spaced from the container base. An extremely preferred construction results from the size of the gap being smaller than the spacing of the disk from the container base, which ensures that particles can pass beneath the disk which are much smaller than the distance between the disk and the base.

In particular when the grinding machine according to the invention is constructed as a liquid grinding machine with a liquid process medium contained in the container, according to a preferred construction the entire disk is rigid. According to a further development in this case, the width or thickness of the gap is at least 1/10 mm and as a rule should not exceed 2 mm. It has surprisingly been found that in the case of a centrifugal force sliding grinding machine according to the invention with liquid in the container, the latter is expelled from the gap between the rotary disk and the base of the stationary container and no liquid is located there. This prevents grinding material, together with broken off fragments of larger grinding bodies or wheels passing into this area and consequently bringing about an impairment of the mounting of the disk or the disk driving spindle passing outwards through the base.

The prevention of the penetration of grinding bodies or fragments thereof or the forcing of the same out of the gap between the rotary disk and the stationary base can be achieved in the case of a dry-working centrifugal force grinding machine, i.e. a dry grinding machine, in that the disk has resilient material, at least on its underside.

As a result of the disk construction according to the invention, it is also ensured that when a grinding body or material particle penetrates the gap it is conveyed outwards again solely through the relative rotary movement between disk and container base, but no wear occurs as a result of the resilience of the disk or its underside and it is in particular ensured that the mounting of the disk is not impaired.

The invention makes it possible to construct very inexpensive, operationally reliable centrifugal force grinding machines, which also permit the use of very fine grinding and/or polishing bodies.

According to another preferred development, a driving spindle of the grinding disk is guided in liquid-tight manner through the container base. The disk or the covering on its underside can e.g. comprise an elastomeric plastic, more particularly rubber, as well as felt, cotton fabric or a normally resilient floor covering, such as a PVC floor covering or the like.

According to a preferred development the disk has an upwardly raised circumferential edge or rim, over most of its surface area the disk has a flat bottom. Only the edge is raised somewhat, so that there is a circumferential edge projecting over the disk bottom.

Even though, more particularly in the case of smaller disks up to a diameter of roughly 250 mm, a grinding seal can be provided between the disk edge and the surrounding cup part, as a result of the limited wear susceptibility of the centrifugal force sliding grinding machine according to the invention associated with the flexible disk, the gap can be larger than the minimum dimensions of the grinding or polishing body particles, but remains of the same order of magnitude as the same and is in particular no more than two or three times this, so that during the operation of the grinding machine said particles migrate beneath the disk and as a result of the relative movement of the flexible, rotary disk are released again with respect to the container base and can be conveyed radially outwards towards the container wall.

With very fine polishing materials, such as walnut granules, the gap should also be very small. With larger or coarser granules, the gap width b is preferably at least 2 mm and at the most preferably ranges between 3 and 4 mm. The gap width can in particular also be variable in order to adapt the gap to the granules used. It is possible to bring about a gap adjustability by using random known means, e.g. by packing shims or the like placed between the container base and the disk. The gap can also be adjustable e.g. by means of setscrews, by means of which a shaft passing through the container base can be vertically adjustable for mounting the flexible disk and fixed at a random height. Alternatively the container can be vertically adjustable with respect to the disk and fixable in a desired height.

A preferred development is characterized in that a closable or sealable outlet is provided beneath the disk in the container base.

According to another preferred development the casing is in one piece and in particular the casing and/or container is made from plastic. As a result the grinding machine according to the invention can be manufactured economically and therefore inexpensively. This is helped by the fact that the gear is positioned below the disk. In an alternative construction the drive is constructed as a geared motor with an integrated gear and then in particular the motor with its shaft is vertically oriented and a driven shaft passes out of the lower end of the motor and the top of the motor is essentially at the same level as the top of the container.

As a result of the grinding unit construction according to the invention, several grinding units can be present in a machine with limited constructional expenditure, e.g. in order to permit the rational machining of heavy and/or shock-sensitive workpieces, which do not allow a joint machining of several workpieces in a single container. It is even possible to provide a very large number of units, e.g. more than 30. The disks of the individual containers can either be separately driven or the grinding machine has a common drive for all the units. In the latter case the disks of the units in each case arranged on one shaft are connected by means of coupling elements, such as meshing gears, V-belts, etc., to the central drive. The disks of individual containers are preferably separately uncouplable from the central drive, so that during the grinding of workpieces in some containers of the grinding machine, the other containers can e.g. be cleaned or emptied and then filled again with workpieces. A grinding machine according to the invention can in particular be used for the dry polishing of jewellery, dental parts, etc.

BRIEF DESCRIPTION OF THE DRAWINGS

The invention described in greater detail hereinafter relative to a preferred embodiment and with reference to the attached drawings, wherein show.

DETAILED DESCRIPTION OF THE PREFERRED EMBODIMENTS

Figure 1:
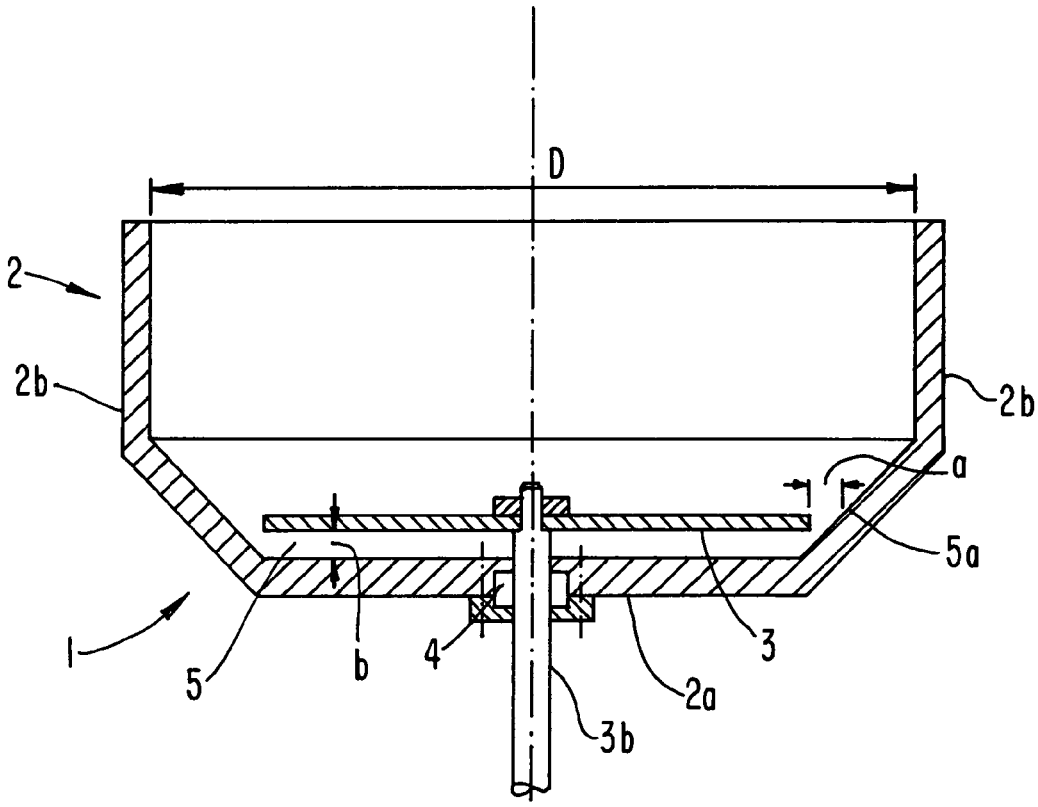
FIG. 1A container of a centrifugal force sliding grinding machine according to the invention.

The grinding 1 of a centrifugal force sliding grinding machine in the form of a disk centrifugal force grinding machine shown in FIG. 1 has a container 2 with a rotary disk 3. If the disk is rigid, working takes place with liquid in the container.

However, for both wet and dry working, the disk can also be of flexible material, e.g. rubber. The disk is driven by a shaft 3*b*. The shaft 3*b* traverses in preferably liquid-tight manner a container base 2*a* and is mounted in rotary manner thereon by means of bearings 4. Accompanied by the formation of a gap 5, the disk 3 is spaced from the container base 2*a* and in the case of dry working the gap width b is e.g. approximately 3 mm. The disk 3 and/or container 2 can be positioned in vertically adjustable manner, e.g. accompanied by a variation of the gap width b.

During the operation of the grinding machine the comparatively wide gap 5 makes it possible for small particles of the grinding material or in particular the grinding bodies or wheels to pass between the disk 3 and container base 2*a* and as a result of the rotary, flexible disk 3 said particles can again be conveyed in the direction of the container wall 2*b*, without there being any significant wear to the container base 2*a* or disk 3. As a result of the flexible disk 3 the production of frictional heat is essentially prevented, in that any grinding body particles passing beneath the disk 3 do not become crushed and instead are conveyed radially outwards.

A grinding machine according to the invention in particular has several, e.g. more than 30 units, which ensure a rational, separate working of relatively heavy (e.g. heavier than 10 g) and/or shock-sensitive workpieces. The diameter D of container 2 can e.g. be approximately 45 cm.

Figure 2:
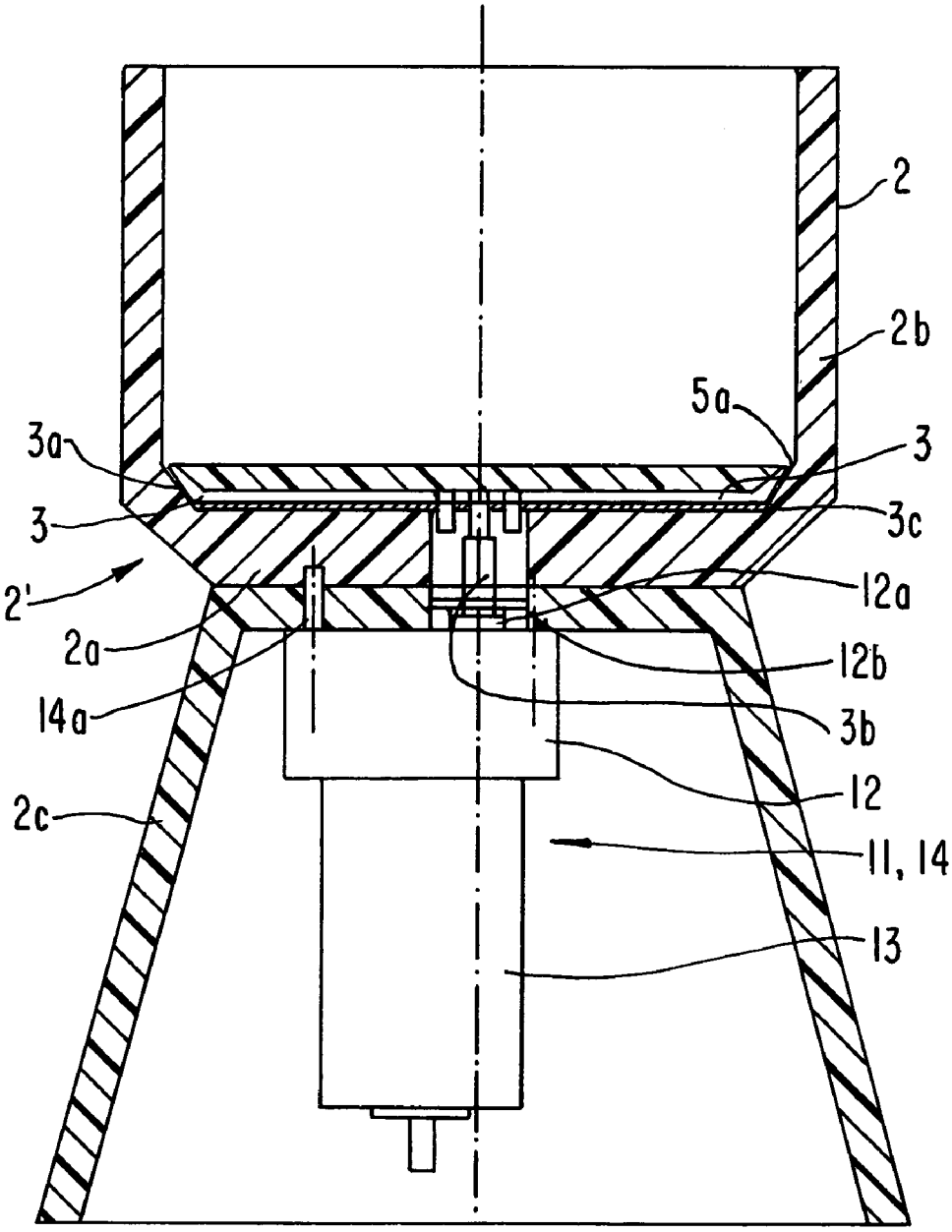
FIG. 2 Another construction of a grinding machine according to the invention.

FIG. 2 shows a different construction of a grinding machine according to the invention, which has a simple construction and can therefore be manufactured at low cost and therefore can be offered for sale at a low price, so that it can also be used in the private sector for polishing private jewellery items.

The grinding machine 1 of FIG. 2 has a one-piece casing 2', which is preferably made from plastic, so that in particular the container 2 is also made from plastic. The container 2 contains a disk 3 which, in this construction, has a resilient material 3*c* on its underside, e.g., an elastomeric plastic covering particularly rubber, or felt, cotton fabric as well as a resilient floor covering, such as a PVC floor covering or the like, and an upwardly inclined circumferential edge 3*a*, whose outer wall follows the container contour in this area, so that radially between the disk 3 or its circumferential edge 3*a* and container 2 or container wall 2*b* a finite gap 5*a* is formed, which has essentially the same size over its entire height. Through the raised disk edge 3*a* a dish-shaped receptacle for the grinding material is created.

The driving shaft 3*b* for the disk 3 passes through the container base 2*b*. The disk is coupled to a driven shaft 12*a* of a gear 12, which is centred by a centring ring 12*b*. In the represented embodiment the drive 11 is constructed as a gear motor 14, motor 13 and gear 12 being integrated together. Thus, not only the gear 12, but also the drive motor 13 is positioned below the container 2 in a foot 2*c* of the casing 2'. The geared motor 14 is fixed by means of screw connections 14*a* to the casing 2'. The geared motor 14 is fixed by means of screw connections 14*a* to the casing 2' and more precisely to the container base 2*a*.

Figure 3:
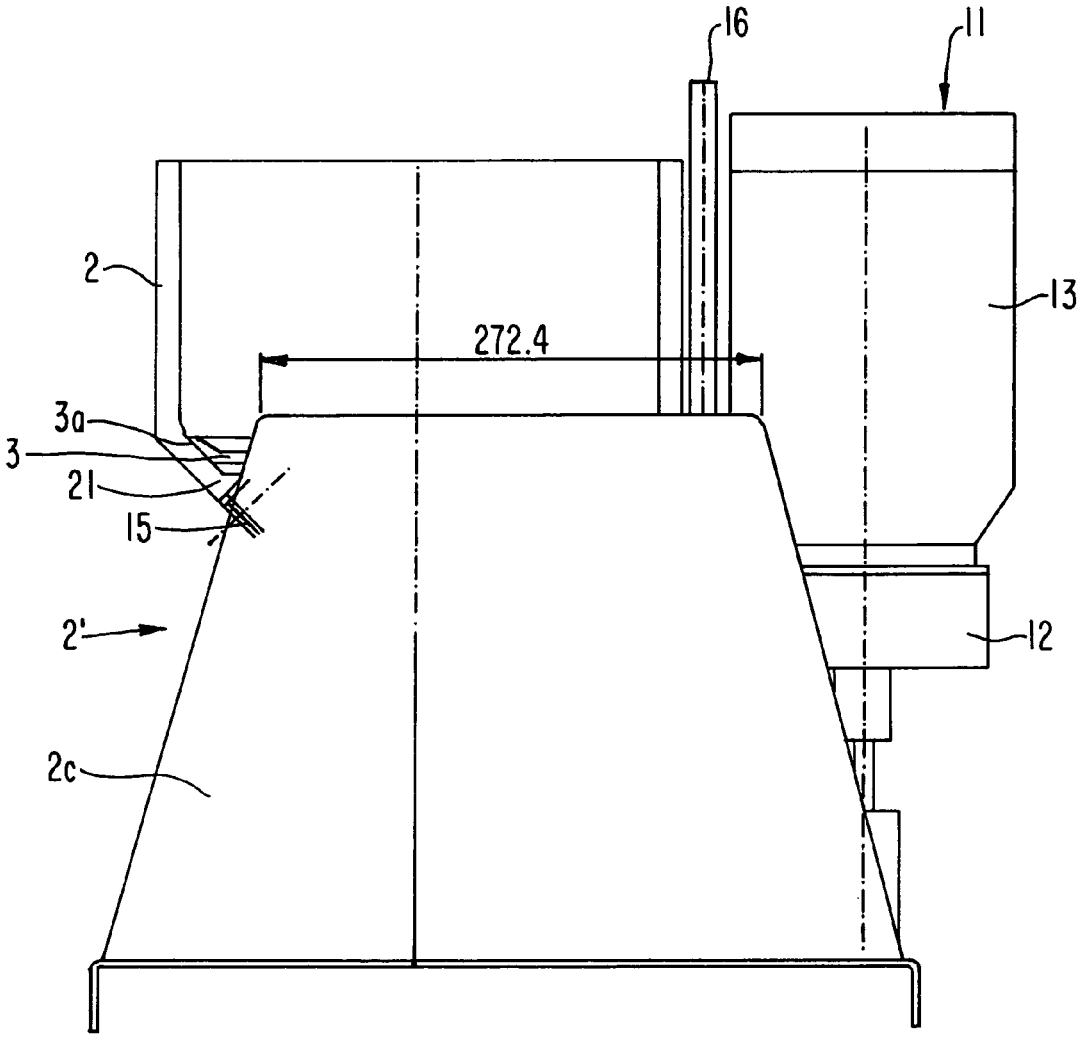
FIG. 3 Another construction of a grinding machine according to the invention in side view.
Figure 4:
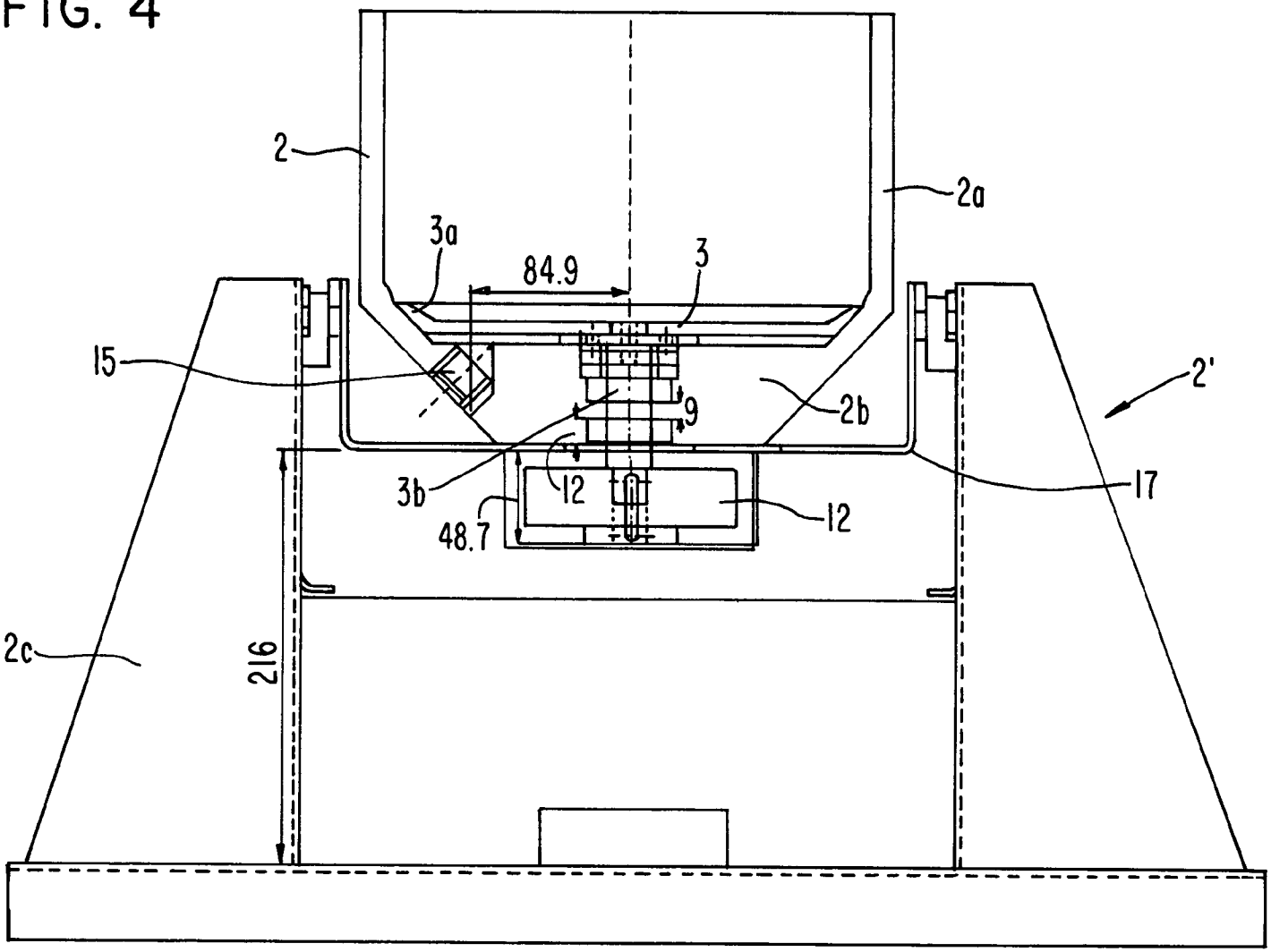
FIG. 4 The essential parts of the machine according to FIG. 3 in vertical section.

FIGS. 3 and 4 show another construction according to the invention, in which the inventive grinding machine also has a simple construction and is therefore inexpensive to manufacture.

In this case the casing 2' has a foot 2*c*, but which is not constructed in one piece with the container 2. In a manner as yet to be explained, the container 2 is instead fixed to the foot 2*c*. In this construction, as is in particular apparent from FIG. 3, a motor 13 is positioned laterally of the container 2 and foot 2*c* in such a way that the driven shaft of the motor 13 (which is not shown) passes downwards out of the motor 13. The gear 12 is also positioned below the motor 13 and the drive 11 can also be constructed as a geared motor 14. The top of the motor 13 is substantially at the same level as the upper edge of the container 2. Between container 2 and motor 13 is provided a protective wall 16, which passes preferably in part arcuate, particularly semiarcuate manner around the container 2. Alternatively the wall area facing the motor 13 can be raised compared with the wall area of the container 2 remote from the motor 13 in order to produce such a protective wall effect.

In the container base 2*a* below the disk 3 is also provided a sealable opening 15 making it possible to remove any grinding material which has passed under the disk 3.

FIG. 4 makes it clear that in the foot 2*c* of casing 2' is provided a U-shaped clip 17, whose legs are fitted to the casing foot 2*c* and whose web carries the container 2. A driving shaft 3*b* for the disk 3 passes through the base 2*a* and the web of the clip 17 into the gear 12, which extends from its parts immediately below the motor 13 to centrally under the container 2, through the provision of corresponding intermediate gears or other transmission designs, such as toothed belts, etc.

What is claimed is:

1. Grinding machine for grinding a grinding material by means of grinding bodies, comprising a stationary container for receiving grinding material and a rotary disk placed above a container base for forming a finite gap with respect to the container wall, the rotary disk being rotatable relative to the container, the rotary disk being made from a resilient flexible material.

2. Grinding machine according to claim 1, characterized in that a driving shaft of the grinding disk passes in liquid-tight manner through the base of the container.

3. Grinding machine according to claim 1, characterized in that an upper side of the disk is rigid.

4. Grinding machine according to claim 1, characterized in that the resilient flexible material is an elastomeric plastic.

5. Grinding machine according to claim 1, characterized in that the flexible material is rubber.

6. Grinding machine according to claim 1, characterized in that the width of the gap is at least 1/10 mm.

7. Grinding machine according to claim 6, characterized in that the gap width is up to 2 mm.

8. Grinding machine according to claim 1, characterized in that the disk has a raised circumferential edge.

9. Grinding machine according to claim 1, characterized by a one-piece casing.

10. Grinding machine according to claim 1, characterized in that a casing and/or the container is made from plastic.

11. Grinding machine according to claim 1, characterized in that a drive motor for the rotary disk is placed beneath the rotary disk.

12. Grinding machine according to claim 11, characterized in that a drive for the disk has a gear between the drive motor and disk.

13. Grinding machine according to claim 12, characterized in that the gear is positioned below the disk.

14. Grinding machine according to claim 12, characterized in that the drive is constructed as a geared motor with integrated gear.

15. Grinding machine according to claim 12, characterized in that the drive motor is positioned below the container in a foot of the casing.

16. Grinding machine according to claim 12, characterized in that the drive motor is positioned laterally of the container.

17. Grinding machine according to claim 16, characterized in that the top of the motor is substantially at the same level as the top of the container.

18. Grinding machine according to claim 1, characterized in that a sealable outlet is provided below the disk in the base of the container.

19. Grinding machine according to claim 1, characterized in that the width of the gap is 0.1 to 2 mm.

20. Grinding machine according to claim 1, characterized in that the disk has an upwardly inclined circumferential edge, an outer wall of the upwardly inclined circumferential edge following a contour of a portion container wall adjacent the upwardly inclined circumferential edge such that the finite gap has a constant width.

21. Grinding machine for grinding a grinding material by means of grinding bodies, comprising a stationary container for receiving grinding material and a rotary disk placed above a container base for forming a finite gap with respect to the container wall, the rotary disk being rotatable relative to the container, the rotary disk being made from a resilient flexible material, and the size of the finite gap between the rotary disk and the container wall being smaller than the spacing of the disk from the container base.

22. Grinding machine according to claim 21, characterized in that the width of the gap is 0.1 to 2 mm.

23. Grinding machine according to claim 21, characterized in that the disk has an upwardly inclined circumferential edge, an outer wall of the upwardly inclined circumferential edge following a contour of a portion container wall adjacent the upwardly inclined circumferential edge such that the finite gap has a constant width.

24. Grinding machine for grinding a grinding material by means of grinding bodies, comprising a stationary container for receiving grinding material and a rotary disk placed above a container base for forming a finite gap with respect to the container wall, the rotary disk being rotatable relative to the container, the rotary disk having a resilient flexible material at least on its underside so that any grinding bodies passing beneath the rotary disk are conveyed radially outwards with rotation of the rotary disk.

25. Grinding machine according to claim 24, characterized in that an upper side of the disk is rigid.

26. Grinding machine according to claim 24, characterized in that the underside of a rigid carrier of the disk is covered with resilient flexible material.

27. Grinding machine according to claim 26, characterized in that the resilient flexible material is an elastomeric plastic.

28. Grinding machine according to claim 26, characterized in that the resilient flexible material is rubber.

29. Grinding machine according to claim 26, characterized in that the resilient flexible material is felt, cotton fabric or resilient flexible floor covering material.

30. Grinding machine according to claim 24, characterized in that the width of the gap is at least 1/10 mm.

31. Grinding machine according to claim 30, characterized in that tye gap width is up to 2 mm.

32. Grinding machine according to claim 30, characterized in that the width of the gap is 0.1 to 2 mm.

33. Grinding machine according to claim 24, characterized in that the disk has an upwardly inclined circumferential edge, an outer wall of the upwardly inclined circumferential edge following a contour of a portion container wall adjacent the upwardly inclined circumferential edge such that the finite gap has a constant width.

* * * * *